US005957019A

United States Patent [19]

Hanaas

[11] Patent Number: 5,957,019

[45] Date of Patent: Sep. 28, 1999

[54] APPARATUS FOR CUTTING OUT A TEST STRIP

[75] Inventor: Torgeir Hanaas, Upplands Väsby, Sweden

[73] Assignee: AB Lorentzen & Wettre, Kista, Sweden

[21] Appl. No.: 08/667,877

[22] Filed: Jun. 20, 1996

[30] Foreign Application Priority Data

Dec. 7, 1995 [SE] Sweden ..... 9502579

[51] Int. Cl.[6] ..... B26D 1/43

[52] U.S. Cl. ..... 83/167; 83/743; 83/81; 83/111; 83/919

[58] Field of Search ..... 83/919, 613, 614, 83/115, 117, 167, 743, 744, 745, 471, 471.2, 491, 591, 924, 937, 947, 81, 111, 145

[56] References Cited

U.S. PATENT DOCUMENTS

| | | | |
|---|---|---|---|
| 3,276,303 | 10/1966 | Tompos | 83/919 |
| 4,527,750 | 7/1985 | Juntti . | |
| 4,577,516 | 3/1986 | Wyser | 83/919 |
| 4,588,119 | 5/1986 | Fernandez-Acebal et al. | 83/919 |

FOREIGN PATENT DOCUMENTS

| | | |
|---|---|---|
| 1 067 616 | 10/1959 | Germany . |
| 346 618 | 10/1972 | Sweden . |
| 444 083 | 3/1986 | Sweden . |
| 2 101 919 | 1/1983 | United Kingdom . |
| 2 212 142 | 7/1989 | United Kingdom . |

*Primary Examiner*—Maurina T. Rachuba

*Attorney, Agent, or Firm*—Burns, Doane, Swecker & Mathis, L.L.P.

[57] ABSTRACT

The invention relates to a cutting apparatus for cutting out at least one strip from a roll with rolled up sheet like material. The apparatus is equipped with finger means which lift out a suitable distance from the roll the layer from which the strip will be cut out. A cutting tool means is placed near each finger means in order to cut through the material. Each cutting tool means is a motordriven, rotating blade driven with a peripheral speed which is considerably higher than the speed with which the cutting apparatus is moved along the roll, or an oscillating knife or the like. During the cutting out operation the cut out strip is rolled up on a rotating roll core means with a torque-adapted rotation. A strip-tensioning arrangement distributes the tensile forces from the rotating roll core means to the strip at the middle of the width of the strip and is placed at the middle of the width of the strip between the cutting tool means and the roll core means.

15 Claims, 4 Drawing Sheets

APPARATUS FOR CUTTING OUT A TEST STRIP

The present invention relates to an apparatus for cutting out strips from rolls of material.

THE STATE OF THE ART

During the manufacturing of paper the finished paper is rolled up in the form of a continuous roll of material with a width of 3–10 meters on a so-called tambour. This is a heavy steel cylinder around a cylinder transport support cylinder and can carry a tens of thousands of meter long rolled up roll of paper. After the rolling up is finished, a test piece must be removed in order to determine the quality and other characteristics of the paper. A strip is cut out across the whole width of the paper and handed in to the laboratory for analysis.

Even if the description refers to the taking of samples of paper on large paper rolls, the invention is not especially limited to this region but is also applicable to the taking of samples of, for example, strips of cloth or metal foils wound on big rolls or the like.

A known device for cutting a strip from a paper roll on a tambour, marketed by Lorentzen & Wettre under the description "L&W Profile Sample Cutter Code SE 147", is carried on a stand equipped with wheels so that it can be moved along the whole width of the paper roll. The device is equipped with a cutting head equipped with two fingers, which are placed parallel with the axis of the tambour and vertical in relation to each other and which lift up the part of the paper which is to be cut out. The cutting is performed with motionless knifeblades placed on the fingers and running through a slit in them. The device is rotatable on the stand around an axis parallel with the axis of the tambour, so that the cutting head can be placed into contact with the surface of the paper roll with the rear side of the two fingers in contact with it. The cut out paper strip hangs down from the cutting stand while the cutting device is moved along the paper roll and is gathered up and rolled by hand to form a roll after the whole strip has been cut out.

Another known device for cutting out one or more strips is described in SE-8106046-9 (SE B-444 083). The cutting device is carried by a cart equipped with wheels which is guided by hand along the width of the paper roll by an operator. The motionless knifeblades, which have a mutual separation which is adapted to the width of the strip to be removed, are at 90° to the direction of motion of the cart and pressed directly against the paper roll in order to cut out a strip from at least the outermost layer of the paper roll. It is stated in the description that the knifeblades can be replaced by cutting wheels, the method of working of which, however, is not more closely defined. The device is not equiped with motorised devices of any kind. The cut out strip is rolled up on a roll core as the cart is moved along the paper roll, wherein the roll core is equipped with gripping means in order to hold the innermost part of the strip. This means that the paper strip is sent to the laboratory together with the roll core or that an operator has to roll off the rolled up tape by hand from the roll core before the strip is sent to the laboratory for analysis.

A problem with both said known strip cutters is that paper fibers attach themselves to the knifeblades or the edges of the cutting wheel when the apparatus is moved along the paper roll. This means that the cutting edges on the roll become uneven and that paper is torn away outside the strip.

A problem with the known device which performs the rolling of the tape on a roll core is partly that the rolled up tape is stuck on the roll core and partly that it is not adapted to different diameters of the roll.

OBJECTS AND SUMMARY

An object of the invention is to produce a cutting device which gives even and distinct cutting edges.

Yet another object of the invention is to produce a cutting device which rolls up the cut out strip and which does not cause any tearing of the cut out strip during the cutting out operation.

Another object of the invention is to produce a cutting device which winds up the test strip and automatically adapts itself according to the diameter of the roll from which the test strip is to be taken.

Yet another object of the invention is to produce a cutting device which winds up the test strip, where the roll cylinder on which the strip is rolled up is easily removable from the test strip roll.

At least one of the objects of the invention is achieved with an apparatus for cutting out strips from rolls of material in which the apparatus is provided with motordriven cutting tool means. The other objects are achieved with the measures stated in the dependent claims.

BRIEF DESCRIPTION OF THE FIGURES

The invention is more closely described below with reference to the appended drawings, where.

DESCRIPTION OF THE EMBODIMENTS

Figure 1A:
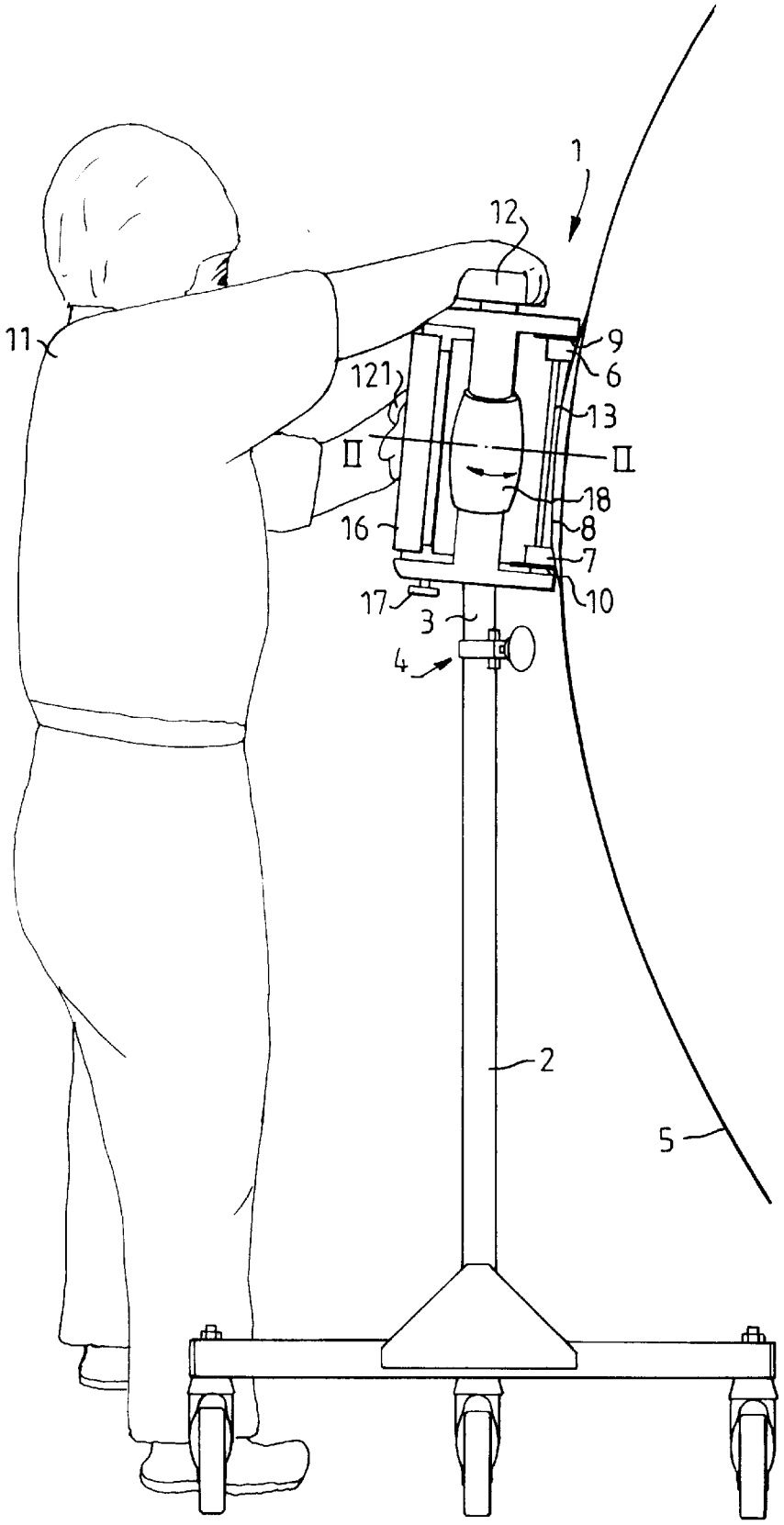
FIGS. 1A–1C show a lateral perspective view of one embodiment of the strip cutter according to the invention and its manipulation at different stages during a sample-taking operation.
Figure 1C:
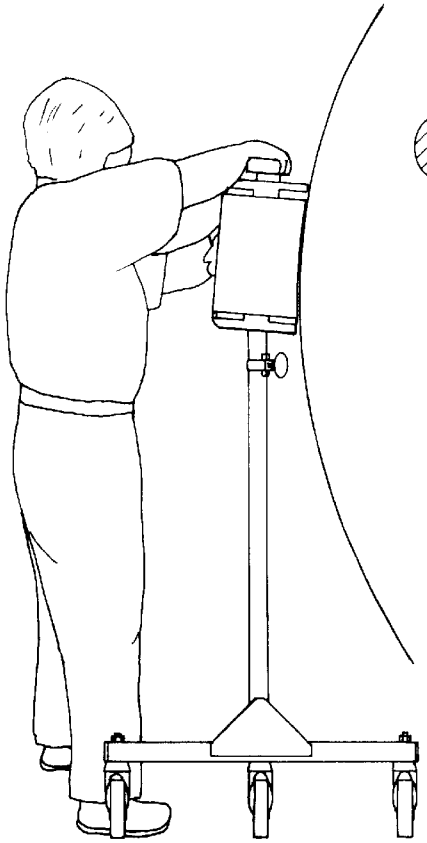
Figure 1B:
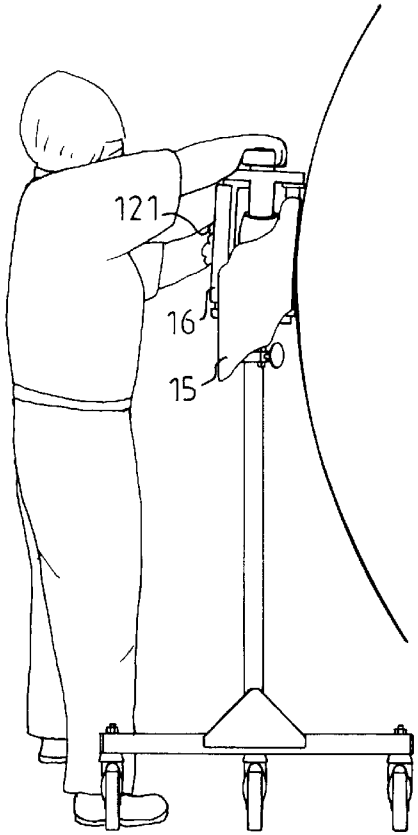

FIGS 1A–1C show the strip cutter placed on a stand 2 equipped with wheels. The strip cutter is vertically adjustable through the strip cutter being placed on a rod 3, which is telescopically movable in a hollow support post and lockable at a suitable height with a locking means 4 of usual type. The strip cutter 1 is placed up against a wide paper roll 5 so that it leans against it. The strip cutter 1 is rotatable about an axis parallel with the axis of the paper roll so that both the cutting units of the strip cutter come into contact with the paper roll.

Each cutting unit is equipped with a finger 6 resp. 7, which from one side are guided into the paper roll under the outermost paper layer from which the strip is to be cut out. This layer 8 is therefore moved out a small distance from the paper roll between the fingers 6 and 7. The outer sides of the fingers rest against the paper roll. The cutter unit also rests against the paper roll with wheels 71 (see FIG. 2), so that during cutting it can be guided like a cart along the paper roll.

Because the paper roll 5 is convex, the fingers are slightly slantingly positioned in their transverse direction in order to adapt to the curved shape of the roll. The cutting takes place with cutting tools outside the fingers as seen from the strip. FIG. 1A shows the strip cutter precisely at one end of the paper roll before the beginning of the cutting but with the fingers 6 and 7 placed under the outer layer of the paper roll. The above is known from "L&W Profile Sample Cutter".

Figure 4:
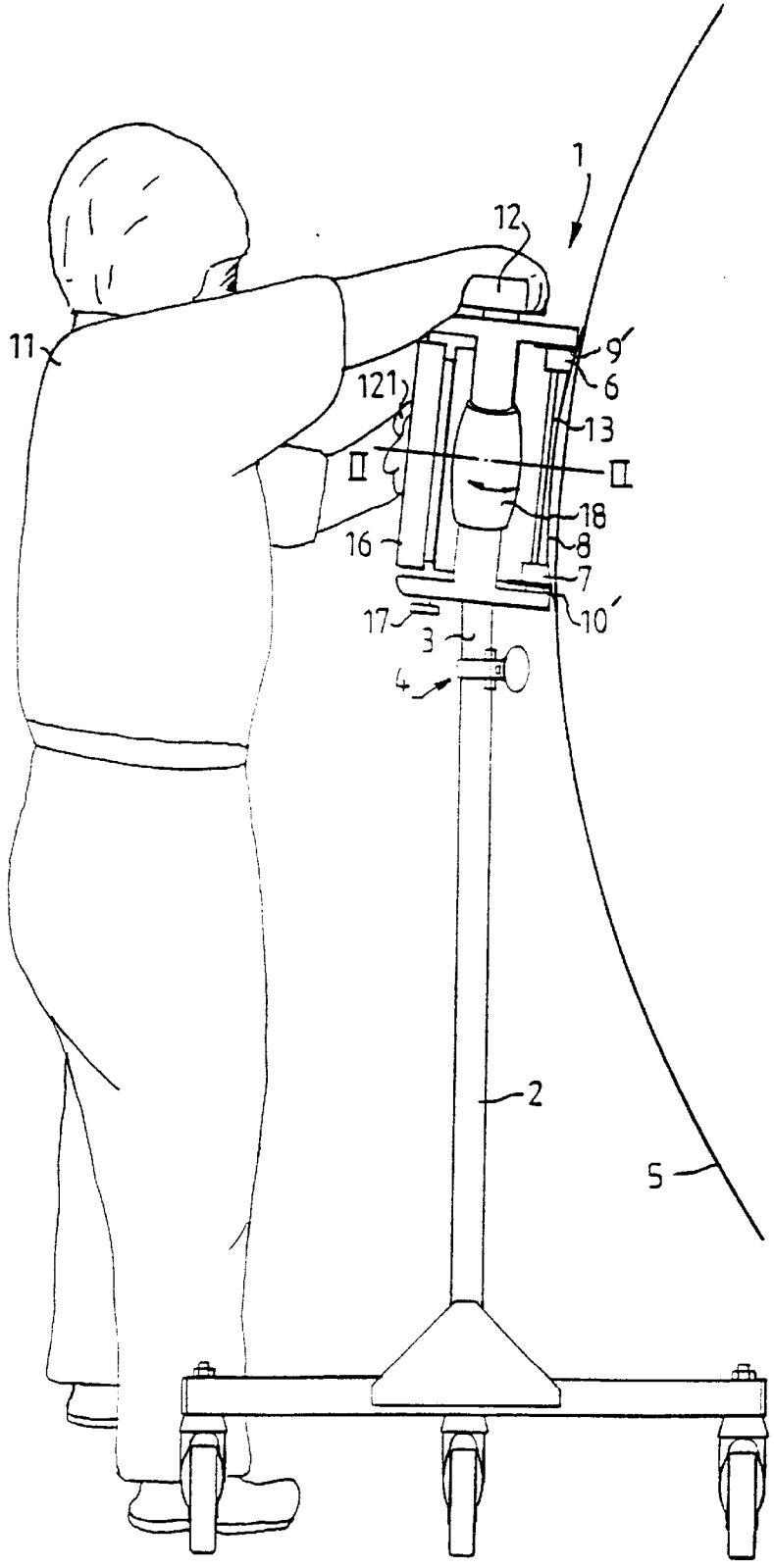
FIG. 4 shows an embodiment of the present invention that includes oscillating knives.

According to the invention, each cutting tool is formed from a movable cutting tool. The figures show rotating blades 9 and 10 placed on the outside of each finger 6,7 as seen from the strip. The blades 9 and 10 shall rotate with a peripheral speed which substantially exceeds, for example by more than 20 times the speed with which the strip cutter is moved along the paper roll during cutting. Each blade is free-cutting and retains its cutting function even with a relatively large distance to the lifting fingers 6 and 7. Moving, for example oscillatingly driven in the direction of cutting, knives 9', 10' can be used instead of the rotating blades (see FIG. 4).

In the embodiment shown each blade lies at a small distance of e.g. ½ mm from its nearby finger so that during rotation it is not influenced by the finger such that no scissor effect occurs between the blade and the finger. It is also possible to have each blade running through a slit in the finger, but this slit must then be so wide that the blade remains free-running. Such a solution, however, is relatively expensive and does not bring any extra advantages.

The fingers must lift up the paper by the inside of the blades in order not to influence the paper roll outside the strip. The cut out strip is guided further through travelling between the fingers. It is possible that each finger fastening 7A can be placed at an equal height with or somewhat outside the blade in order to avoid folding of the strip at its edges, but this is not essential.

A motor 12 placed in a handle drives the blades which in the embodiment shown are on a common shaft 13. However, it is not essential that the blades are synchronously driven, because the only object of having them rotating is to cut through the material. Thus, each blade can be driven by its own motor (not shown) but for the sake of economy it is preferable to drive them with a common motor. It can be advantageous if the blades are driven with a constant and high number of revolutions. In the embodiment shown the casing of the motor 12 has the shape of a handle for the operator 11. This handle is also equipped with start and stop buttons for the motor. The operator 11 holds this handle and yet another handle 121 when the strip cutter is moved along the width of the paper roll 5.

In the embodiment shown shaft 13 is spring-tensioned in one direction so that it can be moved against the spring tension and removed in order to facilitate changing worn-out blades. The shaft is therefore notched at its ends in order to grip a cross bar in the blade holders in order to drive them. The construction of this arrangement does not form part of the invention but can be carried out in many different ways. It is therefore not shown in detail. The blades are located suitably with a screwed joint 14 which rotates with the blades during driving of the motor and the motor shaft. During the change of blades, shaft 13 is demounted and the screw joint screwed apart.

FIG. 1B shows the end 15 of the cut out paper strip when the operator has moved the strip cutter a distance along the paper roll. The strip hangs free at that moment. A rotating roll core 16, upon which the strip is to be wound up, is placed by the side which is facing towards the operator 11. The roll core is removably mounted in a concave housing 161.

The operator guides the end of the strip around the roll core 16, which through its rotation carries with it the end of the paper and this is locked by friction coupling against itself when the operator guides the strip cutter further along the paper roll, and the strip is thereby rolled up tensilely pretensioned on the roll core 16, whereby the roll core does not need to be equipped with any arrangement to which the end of the strip needs to be fastened.

The roll core can be driven by the same motor 12 as the blades but with a geared-down rate of rotation or can be driven by a separate motor (not shown). The gearing and drive arrangements for the rotating parts can be provided in a number of different conventional ways, wellknown to the man skilled in the art, and are therefore not shown in another way than as a motor 12 and the housing 27 in which the gearing can be placed.

The roll core is coupled with a torque control to its drive, e.g. with a slip friction coupling, so that when the paper strip has fastened on the roll 16 and self-locked, the roll 16 will rotate with a rotational speed which corresponds to the feeding of the paper strip dictated by the movement of the strip cutter along the width of the paper roll. The degree of slip friction is suitably adjustable with e.g. a knob 17 for adapting to different types of paper. Cardboard, for example, requires a larger tensile force than thin paper.

According to the invention the tensile force on the cut out strip during winding up on the roll core is distributed to the middle part of the test strip. The largest force then does not fall upon the cut, whereby tearing of the strip is avoided and the winding up on the roll core is more even. Tearing is otherwise difficult to avoid because the strip is the whole time held under tension by the motor driven core strip. Therefore an automatic strip tensioning arrangement 18 is placed so that the cut out paper strip passes over it before it is wound up on the roll core 16. In the embodiment shown it is placed on the rear side of the strip cutter.

Figure 2:
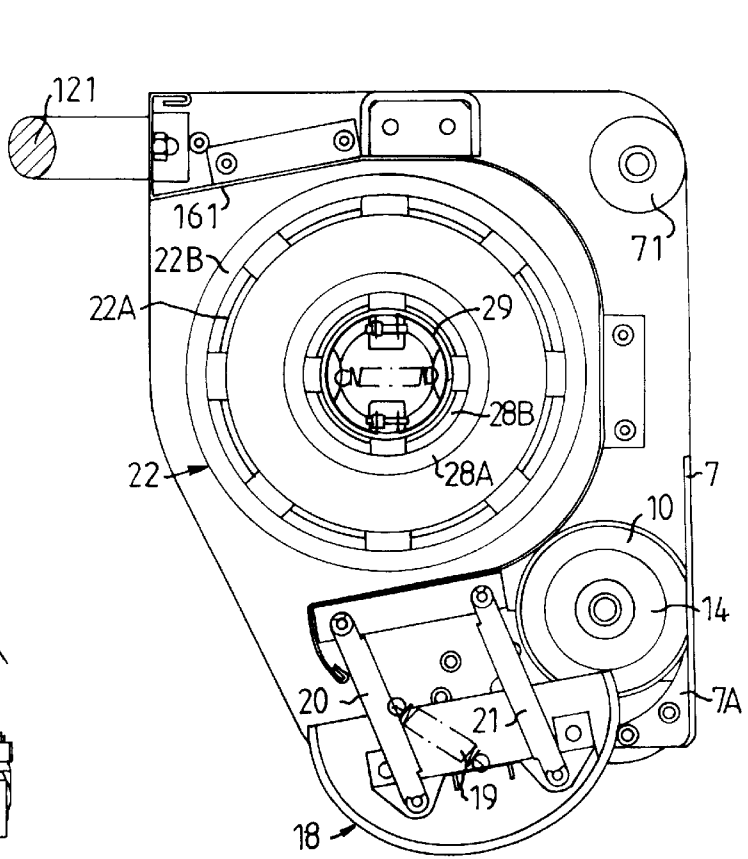
FIG. 2 shows a section through the strip cutter in FIG. 1 along the line II—II.

As can best be seen from the section in FIG. 2, the arrangement 18 has a slightly curved shape along both the strips length and width and is movable back and forth in the side direction, i.e. along the longitudinal direction of the strip, for automatic adjustment to the diameter of the paper roll 5 against which it will come into contact. The cut out strip in this case will directly after cutting first be guided in its longitudinal direction before it is bent towards the strip cutter side facing towards the operator.

In the embodiment shown the strip tensioning arrangement 18 is fastened by the casing of the strip cutter like a pendulum laterally with parallel struts 20,21, which are pivotally fastened in the housing of the strip cutter and in the arrangement 18. A relatively loose spring 19 pretensions the arrangement 18 to its end position forwardly towards the operator and the arrangement is guided in the other direction towards the paper roll 5 by the paper strip when this is pulled away by the rotating roll core 16. The length of the struts 20, 21 is so adapted that one of the ends of the strip tensioner can be moved into contact with the paper roll 5, which means that the strip tensioner can adapt itself to different paper roll diameters.

Figure 3:
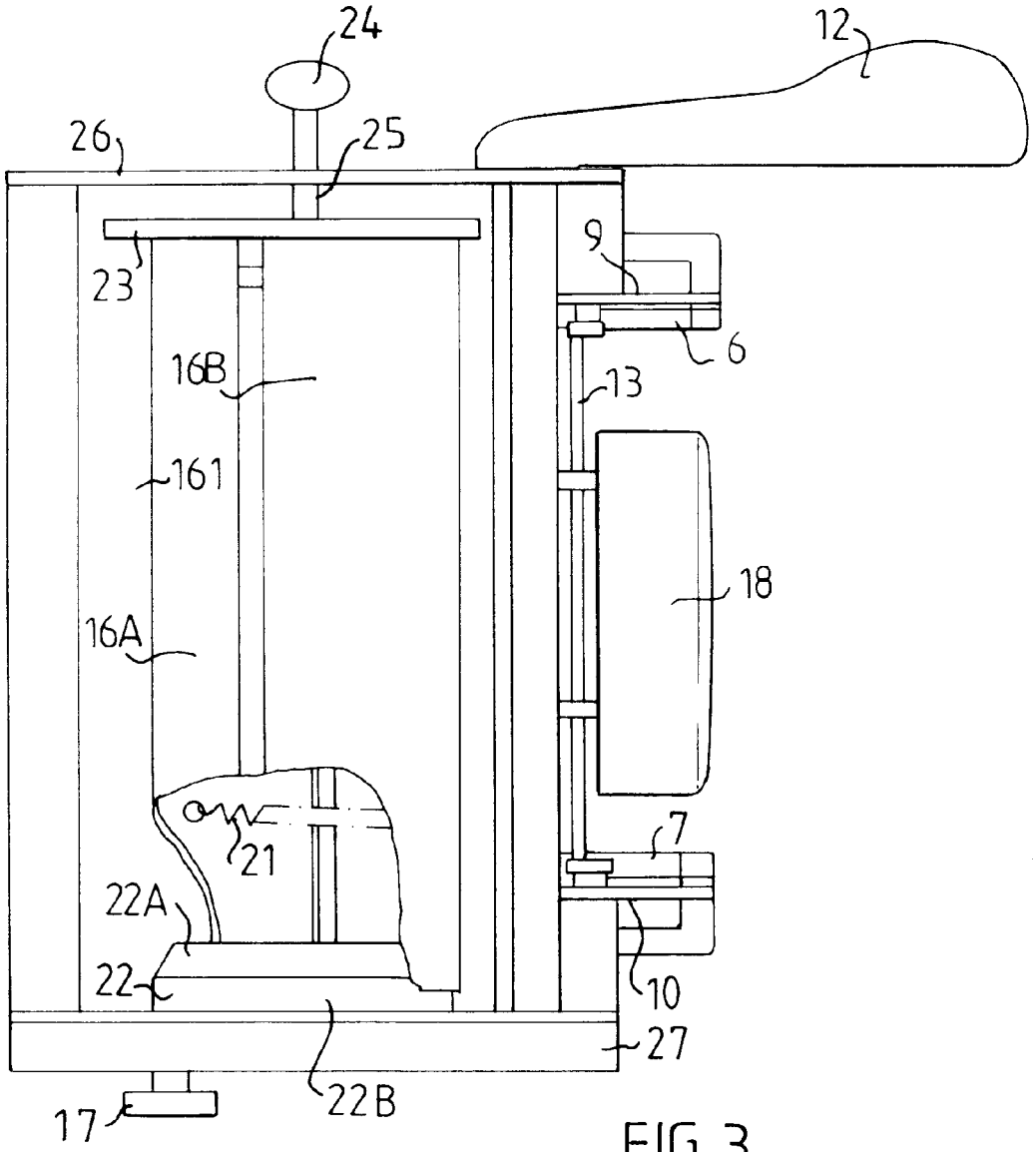
FIG. 3 shows a front view of the strip cutter from the side which is facing away from the roll from which a strip is to be taken.

As can best be seen in FIG. 3, the roll core 16 consists of two halfcylindrical shells 16A and 16B, which are internally pretensioned towards each other by springs 21, one of which is shown in the sectioned part of the roll. It is also possible instead to have several partially cylindrical shells spring-tensioned towards each other (not shown). The essential feature of the arrangement is that the roll core has a variable diameter.

Both ends of the roll core lie on a round support 22, which at least in the part 22A facing towards the roll slopes conically inwardly. The part 22B facing away from the roll can also be slightly conical but with a considerably smaller inclination. It can also be straight even if the removal of a roll equipped with a rolled up strip will then be more difficult than if also the part 22B were somewhat conical. The transition between parts 22A and 22B is slightly rounded. A support with the same shape is fastened inwardly to the roll core on an upper plate 23. The position of the plate 23 in the vertical direction is maneuverable by a lever 24. Before being placed on the support the parts 16A and 16B of the roll core are moved into contact with each other by the springs 21. The plate 23 is lifted up. The lower part of the roll core is fitted around the base part 22A which has an outer diameter which is considerably less than that of the unmounted roll, and its upper part fits around the corresponding base part on plate 23. Then lever 24 is pressed down and the roll core is guided at the top and base onto parts 22A and 22B, whereby its diameter is expanded.

A part of the bar 25 of lever 24 fastened on plate 23 under an upper part 26 of the strip cutter casing is preferably equipped with a snap arrangement which through counteracting forces from part 26 prevents the plate with the lever from being forced upwards again once it has been guided downwards but of which the snapping force is easily overcome by the operator when plate 23 later has to be lifted up and the roll core with the wound on strip is to be lifted out.

When the roll core is taken out, the springs 21 contract it so that it has a significantly smaller diameter than during the rolling up of the strip. The roll core 16 can then be easily taken out from the rolled up strip and can directly be replaced again in the strip cutter for a new utilisation at the same time as the rolled up strip is sent to the laboratory for analysis. This is a clear advantage in comparison to the arrangement which is shown in the above mentioned SE-8106046-9, where the strip must either be unrolled after cutting out or the roll core must be sent with the strip to the laboratory.

It should be noted that the above described arrangement with a roll core with variable diameter represents a convenient embodiment but that variable diameter of the roll can be achieved in many ways. For example, the roll core can be made of an expandable balloon foremost to be used when a test strip of a relatively stiff paper is to be rolled up, such as cardboard. The roll core must, however, be able to rotate which puts certain requirements onto its design. For example, it should have a rigid upper and lower part which are synchronously driven. It can also be possible to use a divided cylinder of the same sort as cylinder 16A,16B internally equipped with a balloon or equipped with a flexible elastic material in the joints between the cylinder halves. The inside of the roll core can be made leakproof. A small compressed air machine can blow up the roll core before the winding of a test strip. In such an embodiment a base for the roll core can be made rotatable at its underside so that the roll can be folded out towards the operator after the winding of the strip. The operator can subsequently let the air out from the inside of the roll core so that the diameter of the roll core diminishes. The roll core can in this case remain in the strip cutter when the rolled up test strip is taken away. In order to support the roll core during the rolling up operation, there could be an arrangement similar to plate 23 which is placeable on and removable from the roll core. The rotation of the roll core can possibly be driven through this plate.

The lower base of the roll core is driven in the embodiment shown by the motor 12 via drive shaft 13 and gearing with slip-friction coupling placed in a housing 27 on the underside of the strip cutter. The degree of slip friction coupling can be adjusted with the handle 17. Instead of slip friction coupling the roll core can be driven with a torque-adjusted motor or gearing comprising an adjustable friction coupling (not shown).

As is evident from FIG. 2, in the embodiment shown core rolls with different diameters can be used. For example, it is appropriate to roll up a test strip of cardboard on a roll core with a large diameter and a test strip of cigarette paper on a roll core with a small diameter. In the figures, two bases 22A,22B and 28A,28B with different diameters but with the same shape are shown concentric to each other. FIG. 2 also shows a section through a roll core 29 with a considerably smaller diameter than the roll core 16, which is shown in the other figures and placed to be exactly pushed on to the base 28A,28B with the smaller diameter.

The outer surface of the roll core can possibly have a coating of a friction material so that the paper strip shall more easily be guided around the roll core at the beginning of the winding operation than if the roll core surface were completely smooth. However, this is not absolutely necessary as the paper in any case is guided around the roll core when it rotates and friction is subsequently obtained between the layers of the strip which, of course, are tightened against each other through the constant driving of the roll. Through the motor drive of the roll the strip is held tensioned during the whole of the strip cutting operation. This means that the operator can stop during the sample-taking without the strip coming loose from the roll core.

I claim:

1. A cutting apparatus for cutting out at least one strip straight across a roll with rolled up, sheet-like material, which apparatus comprises:

finger means which lift out a suitable distance from the roll a layer from which the strip is to be cut out;

a cutting tool placed by the finger means in order to cut through the material;

a motor for driving the cutting tool during the operation with a continuous movement in a longitudinal direction of the strip; and said cutting tool being driven with a peripheral speed which is considerably higher than a speed with which the cutting apparatus is guided along the roll.

2. Cutting apparatus according to claim 1, further comprising a motordriven rotating roll core with torque-adapted rotation on which the strip is to be rolled up on during the cutting out operation.

3. Cutting apparatus according to claim 2, further comprising a strip-tensioning arrangement, which distributes the tensile force from the rotating roll core to the strip at the middle of the width of the strip, is placed at the middle of the width of the strip between said cutting tool and said roll core.

4. Cutting apparatus according to claim 3, wherein said strip-tensioning arrangement is curved out somewhat on a surface over which the strip runs.

5. Cutting apparatus for cutting out at least one strip straight across a roll with rolled up, sheet-like material which apparatus comprises:

finger means which lift out a suitable distance from the roll the layer from which the strip is to be cut out:

a cutting tool means placed by each of said finger means in order to cut through the material;

rotating roll core means with torque-adapted rotation on which the cut out strip is to be rolled up on during the cutting out operation;

and a strip-tensioning arrangement distributing the tensile force from said rotating roll core means to the strip at the middle of the width of the strip between said cutting tool means and said roll core means.

6. Cutting apparatus according to claim 5 wherein said strip-tensioning arrangement is curved out somewhat on the surface over which the strip runs.

7. Cutting apparatus according to claim 5, wherein said strip-tensioning arrangement is movable like a pendulum in the same direction as the strip for automatic setting according to the direction of pull on the strip from said rotating roll core means with wound-on strip.

8. Cutting apparatus according to claim 7, whereing said strip-tensioning arrangement is spring-pretensioned towards one direction.

9. Cutting apparatus according to claim 5, wherein the diameter of said roll core means is variable so that it has its largest diameter during the rolling up operation for the strip and so that the diameter is variable to a smaller diameter after the end of the rolling up operation.

10. Cutting apparatus according to claim 9, wherein said roll core means comprises partial cylinder parts spring-pretensioned towards each other.

11. Cutting apparatus according to claim 9, wherein said roll core means is expandable through compressed air during the strip-taking operation.

12. Cutting apparatus according to claim 5, wherein each cutting tool means during the cutting operation is driven with a continuous movement in the longitudinal direction of the strip, said cutting tool means being a rotating blade means which is driven with a peripheral speed which is considerably higher than the speed with which the cutting apparatus is guided along said roll means.

13. Cutting apparatus according to claim 1, wherein the cutting tool includes a rotating blade.

14. Cutting apparatus according to claim 1, wherein the cutting tool includes an oscillating knife.

15. Cutting apparatus according to claim 5, wherein the cutting tool means includes an oscillating knife.

* * * * *